US008100278B2

(12) United States Patent
Dlouhy

(10) Patent No.: US 8,100,278 B2
(45) Date of Patent: Jan. 24, 2012

(54) DRINK BOTTLE WITH A PROMOTIONAL OBJECT

(76) Inventor: Pavel Dlouhy, Dolni Benesov-Zabreh (CZ)

( * ) Notice: Subject to any disclaimer, the term of this patent is extended or adjusted under 35 U.S.C. 154(b) by 337 days.

(21) Appl. No.: 12/439,487

(22) PCT Filed: Apr. 10, 2007

(86) PCT No.: PCT/CZ2007/000026

§ 371 (c)(1), (2), (4) Date: Apr. 8, 2009

(87) PCT Pub. No.: WO2008/025301

PCT Pub. Date: Mar. 6, 2008

(65) Prior Publication Data

US 2010/0006534 A1 Jan. 14, 2010

(30) Foreign Application Priority Data

Aug. 31, 2006 (CZ) ..... PUV 2006-18046

(51) Int. Cl.
*B65D 23/12* (2006.01)
*B65D 71/00* (2006.01)

(52) U.S. Cl. ..... 215/383; 215/6; 215/386; 206/497; 206/504; 220/23.4; 220/23.83

(58) Field of Classification Search ..... 215/383, 215/6, 10, 385, 386, 365; 206/497, 504; 220/23.4, 23.83
See application file for complete search history.

(56) References Cited

U.S. PATENT DOCUMENTS

| | | | | | |
|---|---|---|---|---|---|
| 2,013,475 | A * | 9/1935 | Orton | 206/229 |
| 2,780,225 | A * | 2/1957 | Barr et al. | 604/403 |
| 3,225,951 | A * | 12/1965 | Poston et al. | 215/6 |
| 3,445,033 | A * | 5/1969 | Sweet et al. | 220/705 |
| 4,881,915 | A * | 11/1989 | Liaw | 446/153 |
| 4,932,542 | A * | 6/1990 | Chen et al. | 215/383 |
| 5,316,398 | A * | 5/1994 | Chandaria et al. | 401/18 |
| 5,351,851 | A * | 10/1994 | Powell | 220/503 |
| 5,664,671 | A * | 9/1997 | Nedblake, Jr. | 206/217 |
| 5,669,519 | A * | 9/1997 | Notz et al. | 215/10 |
| D400,789 | S * | 11/1998 | Rupert | D9/516 |
| 6,206,218 | B1 * | 3/2001 | Young et al. | 220/23.4 |
| 6,575,807 | B2 * | 6/2003 | Spector | 446/320 |
| D479,985 | S * | 9/2003 | Lowance | D9/742 |
| D545,199 | S * | 6/2007 | MacLean | D9/517 |
| 7,404,497 | B2 * | 7/2008 | Lowance | 220/23.4 |
| 8,033,409 | B2 * | 10/2011 | Lindemann | 220/4.21 |
| 2004/0226904 | A1 * | 11/2004 | Schroeder | 215/6 |
| 2006/0091097 | A1 * | 5/2006 | Cooper | 215/6 |
| 2008/0230504 | A1 * | 9/2008 | Nowzari | 215/6 |

* cited by examiner

*Primary Examiner* — Sue Weaver
(74) *Attorney, Agent, or Firm* — Ryan A. Schneider, Esq.; Troutman Sanders LLP

(57) ABSTRACT

Drink bottle with a promotional object, characterised by the plastic or glass body (1) of the drink bottle being on at least one point provided with a concave recess (2), into which a object (3) is inserted and at least a part of the surface of the drink bottle with the object (3) is covered with wrapping (4), constituting namely the drink bottle label, when the cover (4) is advantageously made of shrink-wrap.

13 Claims, 2 Drawing Sheets

DRINK BOTTLE WITH A PROMOTIONAL OBJECT

CROSS-REFERNCE TO RELATED APPLICATION

This application is a U.S. National Stage of International Application No. PCT/CZ2007/000026, filed 10 Apr. 2007, which claims the benefit of CZ PUV 2006-18046, filed 31 Aug. 2006.

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

BACKGROUND OF THE INVENTION

1. Field of the Invention

Present technical solution refers to the new solution of a drink bottle in which a promotional object is placed, creating one unit with the bottle.

2. Description of Related Art

The drink bottles according to the present state of art do not contain promotional objects, and when the bottles are provided with a promotional object, it is either freely enclosed to the bottle or tied or glued to it. This solution is disadvantageous because of the unsatisfactory fixation of the promotional object.

BRIEF SUMMARY OF THE INVENTION

Said disadvantages are to a great extent corrected by the drink bottle with a promotional object according to this technical solution, whose subject-matter is, that the plastic or glass body of the drink bottle is at least at one point of its surface provided with a concave recess, into which a promotional object is inserted. Simultaneously, at least a part of the surface of both the drink bottle and the promotional object is covered with wrapping, composing namely the drink bottle label. The wrapping is advantageously made of shrink-wrap. The subject-matter of the present technical solution is also in the body of the drink bottle being made of polyethylene and the promotional object being a toy in an egg-shaped cover, copying the shape of the recess in the drink bottle.

DETAILED DESCRIPTION OF THE INVENTION

Figure 1:
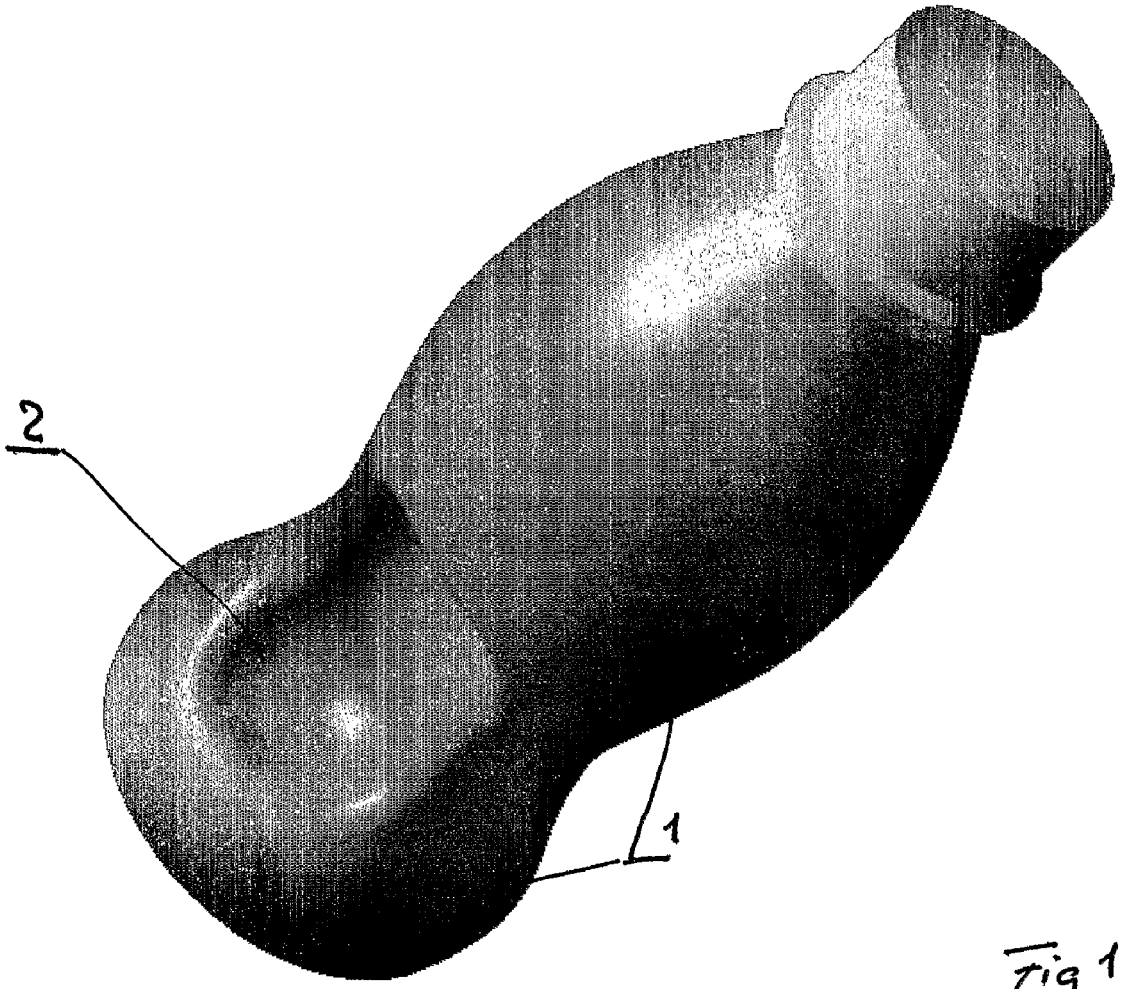
FIG. 1 illustrates a perspective view of a drink bottle provided at one point of its surface with a concave recess, according to an exemplary embodiment of the present invention.
Figure 2:
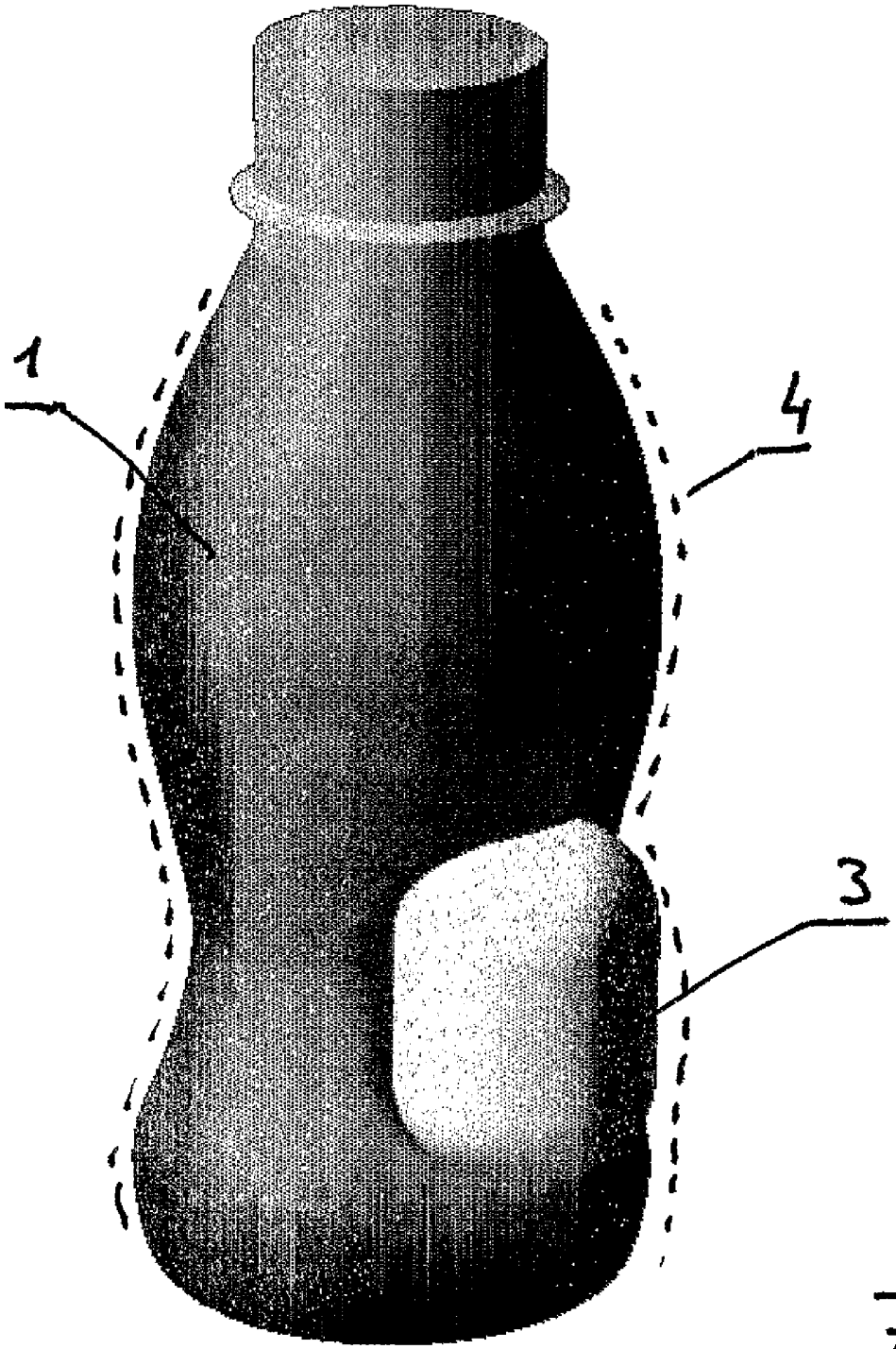
FIG. 2 illustrates another perspective view of the bottle of FIG. 1 with a promotional object inserted into the concave recess, according to an exemplary embodiment of the present invention.

The technical solution according to this technical solution is disclosed by the drawing, on which the drink bottle with a promotional object according to the present technical solution. FIG. 1 shows a drink bottle provided at one point of its surface with a concave recess and FIG. 2 shows a drink bottle with a promotional object inserted into the concave recess. The surface of the drink bottle with a promotional object is covered with wrapping.

A plastic drink bottle with a promotional object 3 is required, where the promotional object 3 would form a part of the bottle while maintaining to be easily removable. That is the reason for the concept of the technical solution of a drink bottle with a promotional object 3 according to the present technical solution. The body 1 of the drink bottle is made from polyethylene and by pressing the polyethylene on the bottle's side an egg-shaped recess 2 is created, according to the size of the large part of an egg of height of 40 mm. Into this recess 2 a promotional object 3 is inserted. The promotional object 3 is a plastic egg-shell cover-and egg of height of 40 mm, which can be divided into halves. In the plastic cover of the egg, small particles are placed, from which a toy can be constructed. The surface of the drink bottle with a promotional object 3 is provided with cover 4 made by shrink-wrap, which is shrank by known means. The shrink-wrap is graphically modified so as to form the label of the drink bottle.

Present technical solution can be utilised in production of drink bottles supposed to contain a promotional object because of promotional purposes.

The invention claimed is:

1. Drink bottle with a promotional object comprising:

a drink bottle having a body, the body provided with a concave, egg-shaped recess;

an egg-shaped promotional object insertable into at least a portion of the concave, egg-shaped recess, a portion of the object extending beyond the body of the drink bottle; and wrapping covering at least a portion of the surface of the drink bottle and the entirety of the promotional object extending beyond the body of the drink bottle;

wherein the wrapping is graphically modified so as to form a label for the drink bottle.

2. The drink bottle of claim 1, wherein the body comprises glass.

3. The drink bottle of claim 1, wherein the body comprises plastic.

4. The drink bottle of claim 1, wherein the wrapping comprises shrink-wrap material.

5. The drink bottle of claim 1, wherein the body comprises polyethylene.

6. The drink bottle of claim 1, wherein the egg-shaped promotional object has a height of 40 mm.

7. The drink bottle of claim 1, wherein the concave, egg-shaped recess has a height of 40 mm.

8. Drink bottle with a toy enclosed in an egg-shaped cover comprising:

a drink bottle having a body, the drink bottle having a waist portion of smaller diameter than a lower bottom portion and an upper shoulder portion, the waist portion of the body provided with an egg-shaped concave recess, the recess not extending outside the waist portion of the drink bottle;

a toy enclosed in an egg-shaped cover insertable into at least a portion of the egg-shaped concave recess, the egg-shaped cover cooperatively shaped so a portion of the egg-shaped cover fits smoothly within the egg-shaped concave recess, and a remaining portion of the egg-shaped cover extends beyond the body of the drink bottle in the waist portion of the drink bottle; and wrapping covering at least a portion of the surface of the drink bottle and the entirety of the egg-shaped cover extending beyond the body of the drink bottle in the waist portion of the drink bottle;

wherein the wrapping is graphically modified so as to form a label for the drink bottle, and comprises shrink-wrap material.

9. The drink bottle of claim 8, wherein the body comprises glass.

10. The drink bottle of claim 8, wherein the body comprises plastic.

11. The drink bottle of claim 8, wherein the body comprises polyethylene.

12. The drink bottle of claim 8, wherein the egg-shaped cover has a height of 40 mm.

13. The drink bottle of claim 8, wherein the egg-shaped concave recess has a height of 40 mm.

* * * * *